US007763122B2

(12) United States Patent
Bae et al.

(10) Patent No.: US 7,763,122 B2
(45) Date of Patent: Jul. 27, 2010

(54) NON-ORIENTED ELECTRICAL STEEL SHEETS WITH IMPROVED MAGNETIC PROPERTY AND METHOD FOR MANUFACTURING THE SAME

(75) Inventors: Byung-Keun Bae, Kyungsangbuk-do (KR); Jae-Kwan Kim, Kyungsangbuk-do (KR)

(73) Assignee: POSCO Co., Ltd. (KR)

( * ) Notice: Subject to any disclaimer, the term of this patent is extended or adjusted under 35 U.S.C. 154(b) by 52 days.

(21) Appl. No.: 12/095,209

(22) PCT Filed: Dec. 18, 2006

(86) PCT No.: PCT/KR2006/005521

§ 371 (c)(1),
(2), (4) Date: May 28, 2008

(87) PCT Pub. No.: WO2007/074987

PCT Pub. Date: Jul. 5, 2007

(65) Prior Publication Data

US 2008/0260569 A1 Oct. 23, 2008

(30) Foreign Application Priority Data

Dec. 14, 2006 (KR) ..... 10-2006-0127865
Dec. 27, 2006 (KR) ..... 10-2005-0130388

(51) Int. Cl.
*H01F 1/16* (2006.01)

(52) U.S. Cl. ..... 148/307; 148/111

(58) Field of Classification Search ..... None
See application file for complete search history.

(56) References Cited

U.S. PATENT DOCUMENTS

| | | | | |
|---|---|---|---|---|
| 5,074,930 | A | 12/1991 | Nishimoto et al. | |
| 5,803,988 | A * | 9/1998 | Bae et al. | 148/111 |
| 5,803,989 | A * | 9/1998 | Kawamata et al. | 148/120 |
| 6,139,650 | A | 10/2000 | Oda et al. | |
| 6,425,962 | B1 * | 7/2002 | Kawamata et al. | 148/307 |

FOREIGN PATENT DOCUMENTS

| | | |
|---|---|---|
| JP | 08283803 | 10/1996 |
| JP | 08283853 | 10/1996 |
| JP | 11222653 | 8/1999 |
| JP | 2005002401 | 1/2005 |
| JP | 2005206887 | 8/2005 |

* cited by examiner

*Primary Examiner*—John P Sheehan
(74) *Attorney, Agent, or Firm*—The Webb Law Firm

(57) ABSTRACT

The invention relates to a non-oriented electrical steel sheet, widely used as an iron core in electric devices, and to a method of manufacturing the same. The non-oriented electrical sheet includes 0.004 wt. % or less C; 1.0-3.5 wt. % Si; 0.02 wt. % or less P; 0.001 wt. % or less S; 0.2~2.5 wt. % Al; 0.003 wt. % or less N; 0.004 wt. % or less Ti; Mn, in which the amount thereof is represented by the following formula (1): $0.10+100\times S(wt.\%)\leqq Mn(wt.\%)\leqq 0.21+200\times S(wt.\%)$—(1); a balance of iron; and inevitable impurities. Final magnetic properties are greatly improved because fine precipitates are formed by S, the amount of Mn can be suitably determined in order to inhibit the formation of the fine precipitates, the formation of fine precipitate CuS is inhibited because precipitates CuS, MnS are formed by adding Sn, Ni and Cu, and a texture, which determines a temperature of annealing a hot rolled steel plate and magnetic properties, is controlled, thereby manufacturing an inexpensive and optimum non-oriented electrical steel sheet.

6 Claims, No Drawings

NON-ORIENTED ELECTRICAL STEEL SHEETS WITH IMPROVED MAGNETIC PROPERTY AND METHOD FOR MANUFACTURING THE SAME

TECHNICAL FIELD

The present invention relates to a non-oriented electrical steel sheet, widely used as an iron core material in electric devices such as motors, transformers and the like, and to a method of manufacturing the same, and, more particularly, to a non-oriented electrical steel sheet having an excellent magnetic property, in which iron loss is decreased and magnetic flux density is improved, and to a method of manufacturing the same.

BACKGROUND ART

Generally, a non-oriented electrical steel sheet is an important part that is necessary for converting electric energy into mechanical energy in electric devices. In order to reduce the consumption of energy, it is necessary to decrease iron loss and increase magnetic flux density. Particularly, when the magnetic flux density is increased, power loss in an electric device can be decreased, thereby enabling the miniaturization of the electric device.

This non-oriented electrical steel sheet is used as an iron core material in rotating devices such as motors, generators and the like and in stationary devices such as small-sized transformers, and is the most important part of these electric devices. An iron core is used to increase the strength of a magnetic field when the magnetic field is formed by supplying electric current. In this case, when the magnetic property of the non-oriented electrical steel sheet is excellent, the efficiency of a motor is high and the consumption of electricity can be reduced.

Recently, an electrical steel sheet for a motor for moving an electric car has received a lot of interest because the most important material used for the motor is a non-oriented electrical steel sheet.

Magnetic properties of the non-oriented electrical steel sheet include iron loss and magnetic flux density. Iron loss is loss occurring when a magnetic field is applied, and magnetic flux density is the amount of work that can be performed at that time, that is, rotation power in a motor. Accordingly, it is preferred that iron loss be low, and it is required that magnetic flux density be high.

In this case, the iron loss can be decreased by decreasing the thickness of the electrical steel sheet or adding alloy elements in large quantities. However, it is difficult to improve both the iron loss and the magnetic flux density.

In order to manufacture a material having a low iron loss and a high magnetic flux density, clean steel having a small amount of impurities must be manufactured, or steel having improved magnetic properties must be manufactured by adding additional elements. However, there are problems in that, in the former, the manufacturing cost is increased due to the additional processes in the process of manufacturing the clean steel, and, in the latter, the cost of additional elements is increased due to the addition of the additional elements.

In this non-oriented electrical steel sheet, factors having an influence on magnetic properties include additive components and impurity components, and crystal grain sizes and texture in material properties.

In this case, with the increase of the crystal grain sizes, the iron loss is decreased. However, since the magnetic properties are deteriorated when textures that easily magnetize the steel sheets are not formed in spite of largely grown grain size of steel sheets, it is inferred that the texture is more important than the crystal grain size. In the texture, (200) plane, including crystal orientations in which the steel sheets are easily magnetized in a direction parallel to the surface of rolled sheets, is preferable. Further, it is preferred that there be few (111) plane or (211) plane.

In conventional technologies for this non-oriented electrical steel sheet, in Japanese Unexamined Patent Application Publication No. 1996-283803, since the amount of Mn is limited to 0.1% or less, it is difficult to coarsen MnS, which is a fine precipitate.

Further, in Japanese Unexamined Patent Application Publication No. 1996-283853, the amount of impurities is limited, if possible. However, since various kinds of impurities are present, it is difficult to control the amount of the impurities, and the relationship of the impurities to the manufacturing process conditions is unclear.

Further, in Japanese Unexamined Patent Application Publication No. Hei11-222653, it is described that, as the amount of sulfur (S) etc. used as impurities is decreased, magnetic properties are increased, but the amount of sulfur (S) does not relate to the manufacturing process conditions.

Further, U.S. Pat. No. 6,139,650 discloses a non-oriented electromagnetic steel sheet and method for manufacturing the same, in which the amount of sulfur (S) is decreased to 0.001% or less, and elements such as Sn, Sb and the like are additionally added. Here, although the amount of impurities is decreased and additional elements are added, the relationship of other components to the manufacturing process conditions is not described.

DISCLOSURE OF THE INVENTION

Technical Tasks to be Solved by the Invention

Accordingly, the present invention has been made keeping in mind the above problems occurring in the prior art, and an object of the present invention is to provide a non-oriented electrical steel sheet having excellent magnetic properties and a method of manufacturing the same, in which, even if impurities are controlled, magnetic properties are effectively improved, and impurities having a great influence on the steel sheet are removed in consideration of manufacturing conditions, thereby economically meeting both the required impurity content and the manufacturing conditions.

Technical Solution

In order to accomplish the above object, the present invention provides a non-oriented electrical steel sheet having excellent magnetic properties, including 0.004 wt. % or less C; 1.0~3.5 wt. % Si; 0.02 wt. % or less P; 0.001 wt. % or less S; 0.2~2.5 wt. % Al; 0.003 wt. % or less N; 0.004 wt. % or less Ti; Mn, in which the amount of thereof is represented by the following formula (1):

$$0.10+100\times S(\text{wt. }\%)\leqq Mn(\text{wt. }\%)\leqq 0.21+200\times S(\text{wt. }\%) \quad (1);$$

the balance of iron; and inevitable impurities.

Further, the non-oriented electrical steel sheet of the present invention may further include 0.005~0.07 wt. % Sb, 0.005~0.50 wt. % Ni, and 0.005~0.20 wt. % Cu.

Further, in order to accomplish the above object, the non-oriented electrical steel sheet of the present invention is characterized in that the texture coefficient at the center of the thickness of the manufactured steel sheet is represented by the following formula (2):

$$P200>P211 \quad (2)$$

Further, in order to accomplish the above object, the present invention provides a method of manufacturing a non-oriented electrical steel sheet having excellent magnetic properties, including the steps of hot rolling a steel slab into a steel plate, the steel slab having the same composition as the above; continuously annealing the hot rolled steel plate in a temperature range determined by the following formula (3) depending on the amount of S in this continuous annealing stage:

$$771+165000\times S(\text{wt. }\%)\leqq \text{temperature of annealing a hot rolled steel plate } (^\circ\text{ C.})\leqq 851+195000\times S(\text{wt. }\%) \quad (3);$$

cold rolling the annealed steel plate; and annealing the cold rolled steel plate, thereby providing the steel sheet.

Further, in order to accomplish the above object, the method of manufacturing a non-oriented electrical steel sheet of the present invention is characterized in that the texture coefficient at the center of the thickness of the manufactured steel sheet is represented by the above formula (2).

In this case, it is characterized in that the steel slab is reheated to a temperature of 1200° C. or less and coiled at a temperature of 680° C. or less in the hot rolling the steel slab, the cold rolling of the steel plate is performed to have a reduction ratio of 70~88%, and the annealing of the steel plate is continuously performed at a temperature of 800~1070° C.

Advantageous Effects

According to the present invention, final magnetic properties are greatly improved because fine precipitates are formed by S, the amount of Mn can be suitably determined in order to inhibit the formation of the fine precipitates, the formation of the fine precipitates CuS is inhibited because precipitates CuSMnS are formed by adding Sn, Ni and Cu, and texture, which determines a temperature of annealing a hot rolled steel plate and magnetic properties, is controlled, thereby manufacturing an inexpensive and optimal non-oriented electrical steel sheet.

BEST MODE FOR CARRYING OUT THE INVENTION

Hereinafter, preferred embodiments of the present invention will be described in detail.

In a non-oriented electrical steel sheet containing Si, Al and Mn, S is known as an impurity element forming sulfides. In the present invention, there is provided a method of effectively improving magnetic properties by controlling purities.

In the present invention, Mn is added in order to inhibit S from forming fine CuS and MnS precipitates.

Here, Mn is an element which is added depending on the amount of S in order to inhibit MnS and CuS, which are finely precipitated.

As seen in the following formula (1), the amount of Mn is determined depending on the amount of S. It is preferred that the formation of unnecessary Mn be suppressed as much as possible.

That is, the amount of Mn is determined depending on the amount of S.

According to the following formula (1), if the amount of Mn is above a predetermined amount, excessive Mn acts as an impurity.

$$0.10+100\times S(\text{wt. }\%)\leqq Mn(\text{wt. }\%)\leqq 0.21+200\times S(\text{wt. }\%) \quad (1)$$

Further, in the present invention, there is provided a non-oriented electrical steel sheet having excellent magnetic properties, in which the amount of Mn depends on the amount of S, and the texture of the manufactured steel sheet is represented by the following formula (2).

In this case, the texture, which is easily magnetized even if only a small amount of electric current is supplied thereto, is (200) plane including many <100> directions, and the texture coefficient attained in (200) plane is P200 according to Horta formula.

Further, a plane, which is included in a crystalline structure in a large amount and is not easily magnetized, is (211) plane, and the texture coefficient attained in (211) plane is P211 according to Horta formula.

In the present invention, the texture coefficient in the steel sheet manufactured depending on the components and manufacturing condition of the present invention is represented by the following formula (2):

$$P200>P211 \quad (2)$$

Further, in order to accomplish the object, the present invention provides a non-oriented electrical steel sheet having excellent magnetic properties obtained by the manufacturing method including the steps of hot rolling a steel slab into a steel plate, the steel slab including 0.004 wt. % or less C; 1.0~3.5 wt. % Si; 0.02 wt. % or less P; 0.001 wt. % or less S; 0.2~2.5 wt. % Al; 0.003 wt. % or less N; 0.004 wt. % or less Ti; Mn, in which the amount of thereof is represented by the above formula (1); the balance of iron; and inevitable impurities; continuously annealing the hot rolled steel plate in a temperature range determined by the following formula (3) depending on the amount of S in this continuous annealing stage; cold rolling the annealed steel plate; and annealing the cold rolled steel plate, thereby providing the steel sheet.

In this case, S is precipitated into MnS, and thus causes crystal grains to be fine. Therefore, since the texture, which has planes having decreased magnetic properties around the precipitates, is easily formed, the amount of S, if possible, must be small. However, the temperature of annealing hot rolled steel plate in post-processes must be changed depending on the amount of S.

The temperature of annealing hot rolled steel plate depending on the amount of S is represented by the following formula (3):

$$771+165000\times S(\text{wt. }\%)\leqq \text{temperature of annealing a hot rolled steel plate } (^\circ\text{ C.})\leqq 851+195000\times S(\text{wt. }\%) \quad (3)$$

Further, in order to accomplish the object, the present invention provides a method of manufacturing a non-oriented electrical steel sheet having excellent magnetic properties, in which a steel slab, including 0.004 wt. % or less C, 1.0~3.5 wt. % Si, 0.02 wt. % or less P, 0.001 wt. % or less S, 0.2~2.5 wt. % Al, 0.003 wt. % or less N, 0.004 wt. % or less Ti, Mn, in which the amount of thereof is represented by the above formula (1); balance iron; and inevitable impurities, is hot rolled into a steel plate, in which the steel slab is reheated to a temperature of 1200° C. or less and coiled at a temperature of 680° C. or less; the hot rolled steel plate is annealed at a temperature range represented by the above formula (3); the annealed steel plate is cold rolled to have a reduction ratio of 70~85%; and the cold rolled steel plate is continuously annealed at a temperature of 800~1070° C., resulting in the steel sheet, in which the texture is represented by the above formula (3).

Hereinafter, numerical limitation conditions for composition ratios according to the present invention will be described.

[C: 0.004 wt. % or less]

Since the C causes a magnetic aging phenomenon in final products and thus decreases magnetic properties upon the use of the final products, the amount of C is in the range of 0.004 wt. % or less. Furthermore, since the magnetic properties are preferable when the amount of C is decreased, it is preferred that the amount of C be limited to 0.003 wt. % or less in the final products.

[Si: 1.0~3.5 wt. %]

The Si is a component which increases specific resistance and thus decreases an eddy loss in iron loss. When the amount of Si is 1.0 wt. % or less, it is difficult to realize a texture that promotes magnetic properties. In contrast, when the amount of Si is above 3.5 wt. %, a cold rolling property is decreased, and thus a strip rupture phenomenon occurs. Accordingly, it is preferred that the amount of Si be limited within the range of 1.0~3.5 wt. %.

[P: 0.02 wt. % or less]

The P may be added because it increases specific resistance, and thus improves magnetic properties. However, in the present invention, the P serves as an impurity which is segregated in crystal grain boundaries and thus suppresses the growth of crystal grains.

When the excess P is added, a cold rolling property is worsened.

Accordingly, it is preferred that the amount of P be limited within the range of 0.02 wt. % or less.

[S: 0.001 wt. % or less]

Since the S forms MnS, which is a fine precipitate, and thus deteriorates magnetic properties, it is advantageous to maintain the amount of S low. When the amount of S is above 0.001 wt. %, the amount of Mn to be added must be increased in order to suppress the precipitation of fine CuS. Furthermore, when the amount of S is excessively increased, magnetic properties are deteriorated. Accordingly, it is preferred that the amount of S be limited to 0.001 wt. % or less.

[Mn: formula (1) represented according to the amount of S, that is, values between 0.10+100×S(wt. %) and 0.21+200×S (wt. %)]

Since the Mn combines with S and thus forms MnS, which is a fine precipitate that suppresses the growth of crystal grains, the Mn is added in order to form the MnS into a coarser precipitate, and can prevent S from combining to form CuS, which is a finer precipitate. Further, in the present invention, since magnetic properties are not improved even if the amount of Mn is large, it is preferred that the Mn be added in an amount of 0.4 wt. % or less.

It is further preferred that the Mn be added depending on the amount of S represented by formula (1).

[Al: 0.2~2.5 wt. %]

The Al is added because it is a component effective in increasing specific resistance and thereby decreasing an eddy loss. When the Al is added in an amount of 0.2 wt. % or less, AlN, which is a precipitate suppressing the growth of crystal grains, is formed. In contrast, when the amount of the added Al is above 2.5 wt. %, since the degree of magnetic property improvement is decreased compared to the amount of the added Al, it is preferred that the amount of Al be limited to 2.5 wt. %. Accordingly, the Al is added in the range of 0.2~2.5 wt. %.

[N: 0.003 wt. % or less]

The N is added in a small amount because it forms a fine and long AlN precipitate, and thus suppresses the growth of crystal grains. In the present invention, it is preferred that the amount of N be limited to 0.003 wt. % or less.

[Ti: 0.005 wt. % or less]

The Ti forms fine TiN and TiC precipitates and thus suppresses the growth of crystal grains. In the present invention, it is preferred that the amount of Ti be 0.005 wt. % or less.

When the amount of Ti is above 0.005 wt. %, many fine precipitates are formed, so that texture is deteriorated, thereby decreasing magnetic properties.

[Sb: 0.005~0.07 wt. %]

The Sb causes a crystal grain boundary segregation phenomenon, and is characterized in that it is segregated into the crystal grain boundary and the surface of steel sheet after hot rolled steel plate annealing process. In the present invention, the Sb is added because it inhibits S from infiltrating into the crystal grain boundary, prevents crystal grains from growing excessively, and grows the (200) plane in the texture. When the Sb is added in an amount of 0.005 wt. % or less, the effect of the addition thereof is low. In contrast, when the Sb is added in an amount of 0.07 wt. % or more, the effect of addition is also decreased.

Accordingly, in the present invention, the Sb is added in the range of 0.005~0.07 wt. %.

[Ni: 0.005~0.50 wt. %]

The Ni is added because it improves textures, inhibits S from precipitating as fine CuS by being added together with Sb and Cu, and has oxidation resistance and corrosion resistance. When the Ni is added in an amount of 0.005 wt. % or less, the effect of addition is low. In contrast, when the Ni is added in an amount of 0.50 wt. % or more, the effect of addition is also decreased. Accordingly, in the present invention, the Ni is added in the range of 0.005~0.50 wt. %.

[Cu: 0.005~0.20 wt. %]

The Cu is added because it improves textures, inhibits S from being precipitated into fine CuS, help S precipitate as coarsened CuS and MnS, and has oxidation resistance and corrosion resistance. When the Cu is added in an amount of 0.005 wt. % or less, the effect of addition is low. In contrast, when the Cu is added in an amount of 0.20 wt. % or more, the effect of addition is also decreased. Accordingly, in the present invention, the Cu is added in the range of 0.005~0.20 wt. %.

The composition of the present invention includes Fe and inevitable impurities other than the above components.

A steel slab composed of the above composition is reheated to a temperature of 1200° C. or less, and is then hot rolled.

In the method of hot rolling the steel slab, the steel slab is roughly rolled and is then finish rolled. Here, steel containing small amounts of Si and Al is initially rolled in an austenite phase and finally rolled in a ferrite phase. The final rolling in the finish rolling is performed in the ferrite phase. In this hot rolling step, the rolling is performed to have a final reduction ratio of 40% for allowing the correction of the plate shape.

The hot rolled steel plate manufactured as above is coiled at a temperature of 680° C. or less, and is then cooled under ambient conditions.

When the hot rolled steel plate is not annealed, the hot rolled steel plate may be coiled at a temperature of 800° C. or less in order to replace the annealing of the hot rolled steel plate.

The reason is that, when the hot rolled steel plate is coiled at a temperature of 800° C. or more, the hot rolled steel plate is greatly oxidized, and thus an acid pickling property may be deteriorated.

The coiled hot rolled steel plate is annealed, acid pickled, and then cold rolled. The hot rolled steel plate is annealed at a temperature of annealing hot rolled steel plate depending on the amount of S, as represented by formula (3).

That is, the hot rolled steel plate is annealed at a temperature between 771+165000×S(wt. %) and 851+195000×S(wt. %).

Since the size of crystal grains is determined depending on the influence of impurities, the amount of produced AlN is controlled by the amount of added Al. Particularly, in the present invention, since the temperature of annealing hot rolled steel plate is limited based on the amount of S, when the hot rolled steel plate is annealed at a temperature lower than 771+165000×S(wt. %), the growth of crystal grains is insufficient, and when the hot rolled steel plate is annealed at a temperature higher than 851+195000×S(wt. %), texture is deteriorated.

The hot rolled steel plate annealing time is within the range from 10 sec to 10 hours.

The reason is that, when the annealing time is excessively short, the crystal grains do not grow, and, in contrast, when the annealing time is excessively long, the texture is deteriorated.

The hot rolled steel plate is annealed, acid pickled, and then cold rolled.

In the cold annealing process, the hot rolled steel plate is finally rolled into a steel sheet having a thickness of 0.15 mm to 0.70 mm.

In this case, it is preferred that the reduction ratio be in the range of 70~88% in order to form crystal grains having large sizes in final products.

The cold rolled steel sheet is annealed at a temperature of 800~1070° C.

In this case, when the annealing temperature is below 800° C., the growth of crystal grains is insufficient. In contrast, when the annealing temperature is above 1070° C., the temperature of the surface of the steel sheet is excessively increased, thereby forming surface defects on the surface of the steel sheet, and the size of the crystal grains is excessively increased, thereby deteriorating magnetic properties. Accordingly, it is preferred that the temperature of annealing the cold rolled steel sheet be limited to a temperature of 800~1070° C.

The annealed steel sheet is shipped to consumers after insulation film treatment.

The annealed steel sheet may be coated with an organic film, an inorganic film or an organic-inorganic complex film. Further, the annealed steel sheet may be coated with other insulator films.

Thereafter, the consumers can directly use the steel sheet after further processing.

Hereinafter, the present invention will be described with reference to Examples.

EXAMPLE 1

A steel slab composed of components as in Table 1 was reheated to a temperature of 1100° C., and the final rolling in the hot rolling is performed at a temperature of 860° C.

In this case, a reduction ratio at the final stand in the finish rolling was 18%. The steel slab was rolled to a thickness of 1.8 mm, and then coiled at a temperature of 650° C.

In the hot rolled steel sheet, which was coiled and cooled under ambient conditions, as shown in Table 2, a hot rolled steel plate was annealed, acid pickled and then cold rolled to a thickness of 0.35 mm to form a cold rolled steel plate. Then, the cold rolled steel plate was annealed in an atmosphere of hydrogen 35% and nitrogen 65% at an annealing temperature of 1050° C. for 1 minute.

After the annealed steel plate was cut, the magnetic properties and texture coefficients according to Horta formula are compared. The results were given in Table 2.

TABLE 1

| | Component (wt. %) | | | | | | | | | |
|---|---|---|---|---|---|---|---|---|---|---|
| Kind of steel | C | Si | S | P | Mn | Al | N | Ti | 0.10 + 100 × S (%) | 0.21 + 200 × S (%) |
| Invented steel A | 0.0009 | 3.01 | 0.0010 | 0.010 | 0.36 | 0.75 | 0.0009 | 0.0015 | 0.20 | 0.41 |
| Invented steel B | 0.0012 | 3.05 | 0.0007 | 0.004 | 0.21 | 1.22 | 0.0012 | 0.0020 | 0.17 | 0.35 |
| Invented steel C | 0.0025 | 3.02 | 0.0003 | 0.015 | 0.17 | 1.40 | 0.0015 | 0.0006 | 0.13 | 0.27 |
| Invented steel D | 0.0025 | 3.02 | 0.0004 | 0.015 | 0.18 | 1.51 | 0.0015 | 0.0006 | 0.13 | 0.27 |
| Comparative steel A | 0.0009 | 3.03 | 0.0010 | 0.011 | 0.75 | 0.76 | 0.0008 | 0.0020 | 0.20 | 0.41 |
| Comparative steel B | 0.0011 | 3.05 | 0.0006 | 0.005 | 0.39 | 1.25 | 0.0013 | 0.0006 | 0.16 | 0.33 |
| Comparative steel C | 0.0024 | 3.02 | 0.0003 | 0.015 | 0.10 | 1.27 | 0.0014 | 0.0012 | 0.13 | 0.27 |
| Comparative steel D | 0.0024 | 3.02 | 0.0004 | 0.015 | 0.36 | 1.26 | 0.0014 | 0.0012 | 0.14 | 0.29 |
| Comparative steel E | 0.0024 | 3.01 | 0.0004 | 0.015 | 0.10 | 1.26 | 0.0014 | 0.0045 | 0.14 | 0.29 |

TABLE 2

| | Kind of steel | Hot rolled steel plate annealing temperature (° C.) | 771 + 165000 × S (%) | 851 + 195000 × S (%) | Iron loss ($W_{15/50}$) (W/Kg) | Magnetic flux density ($B_{50}$) (Tesla) | Texture coefficient P200 | Texture coefficient P211 |
|---|---|---|---|---|---|---|---|---|
| Invented product 1 | Invented steel A | 980 | 936 | 1046 | 2.21 | 1.69 | 0.75 | 0.43 |

TABLE 2-continued

| | Kind of steel | Hot rolled steel plate annealing temperature (° C.) | 771 + 165000 × S (%) | 851 + 195000 × S (%) | Iron loss ($W_{15/50}$) (W/Kg) | Magnetic flux density ($B_{50}$) (Tesla) | Texture coefficient P200 | Texture coefficient P211 |
|---|---|---|---|---|---|---|---|---|
| Invented product 2 | Invented steel B | 950 | 887 | 988 | 1.95 | 1.68 | 1.20 | 0.95 |
| Invented product 3 | Invented steel B | 920 | 887 | 988 | 1.98 | 1.68 | 1.30 | 0.82 |
| Invented product 4 | Invented steel B | 940 | 887 | 988 | 1.85 | 1.69 | 1.30 | 0.84 |
| Invented product 5 | Invented steel B | 960 | 887 | 988 | 2.01 | 1.69 | 1.30 | 0.80 |
| Comparative product 1 | Invented steel B | 850 | 887 | 988 | 2.31 | 1.64 | 0.50 | 0.75 |
| Comparative product 2 | Invented steel B | 1000 | 887 | 988 | 2.17 | 1.63 | 0.55 | 0.95 |
| Invented product 6 | Invented steel C | 980 | 821 | 910 | 2.85 | 1.73 | 1.30 | 0.84 |
| Invented product 7 | Invented steel D | 980 | 837 | 929 | 2.87 | 1.73 | 1.25 | 0.82 |
| Comparative product 3 | Comparative steel A | 980 | 936 | 1046 | 2.32 | 1.64 | 0.64 | 0.76 |
| Comparative product 4 | Comparative steel B | 970 | 870 | 968 | 2.25 | 1.63 | 0.56 | 0.82 |
| Comparative product 5 | Comparative steel C | 860 | 821 | 910 | 2.28 | 1.64 | 0.61 | 0.86 |
| Comparative product 6 | Comparative steel D | 850 | 837 | 929 | 2.31 | 1.63 | 0.66 | 0.82 |
| Comparative product 7 | Comparative steel E | 850 | 837 | 929 | 2.41 | 1.62 | 0.35 | 0.60 |

1) Iron loss ($W_{15/50}$) is a loss (W/kg) occurring when a magnetic flux density of 1.5 Tesla field is induced at a frequency of 50 Hz.

2) Magnetic flux density ($B_{50}$) is an intensity (Tesla) of magnetic flux induced when a magnetic filed of 5000 A/m is applied.

3) P200 and P211 are texture coefficients measured using the Horta formula, and are average values of 3 points or more at the center of the thickness of the steel sheet. P200 is a crystal plane advantageous to magnetic properties, and P211 is a crystal plane disadvantageous to magnetic properties.

As shown in Table 2, it can be seen that the invented products (1~7), which are manufactured under the manufacturing conditions of the present invention using the invented steel (A~D) meeting the composition range of the present invention, have low iron losses and high magnetic flux densities compared to the comparative products (1~2) when the manufacturing conditions are different, even if the composition range is the same.

Further, it was determined that the comparative steels (A~E), which have different compositions, had bad magnetic properties even if they were manufactured under the same manufacturing conditions.

Moreover, in the comparative steel A, B and D, the amount of Mn exceeded the upper limit value of the present invention, and, in the comparative steel C and E, the amount of Mn did not exceed the upper limit value of the present invention.

EXAMPLE 2

A steel slab, comprising 0.0021 wt. % C; 2.52 wt. % Si; 0.011 wt. % P; 0.0005 wt. % S; 0.55 wt. % Al; 0.0012 wt. % N; 0.0011 wt. % Ti; 0.21 wt. % Mn, in which a preferable amount thereof was 0.15~0.31%; the balance of iron; and inevitable impurities, was reheated to a temperature of 1150° C., and was then hot rolled. In the hot rolling stage, the final rolling in the finish rolling is performed at a temperature of 880° C. to have a reduction ratio of 17%, thereby providing a hot rolled steel sheet having a thickness of 2.2 mm.

The hot rolled steel sheet was coiled at a temperature of 600° C. and then air-cooled. Next, the hot rolled steel sheet was continuously annealed at a temperature of 920° C. for 5 minutes, acid pickled, and then cold rolled to a thickness of 0.5 mm.

In this case, the suitable temperature range in the hot rolled steel plate annealing process was in a range of 854~979° C., and a cold rolled steel plate annealing process was performed at a temperature of 1000° C. in an atmosphere of 70% nitrogen and 30% hydrogen for 1 minute.

After the annealed steel sheet was coated with an organic-inorganic complex insulation film and cut, the magnetic properties of the obtained steel sheet and the sizes of crystal grains were evaluated.

Among the magnetic properties of the steel sheet, iron loss ($W_{15/50}$) was 2.52 W/kg, and magnetic flux density ($B_{50}$) was 1.71 Tesla. Further, texture coefficient at the center of the thickness of the steel sheet product was 1.98 in P200 and was 1.03 in P211, and (P200-P211) was 0.95, therefore P 200 was greater than P211.

EXAMPLE 3

A steel slab, comprising 0.0023 wt. % C; 3.12 wt. % Si; 0.004 wt. % P; 0.0003 wt. % S; 1.47 wt. % Al; 0.0011 wt. % N; 0.23 wt. % Mn in which a preferable amount thereof was 0.13~0.27%; balance iron; and inevitable impurities, was reheated to a temperature of 1220° C., and was then hot rolled.

In the hot rolling stage, the end temperature in finish rolling was 880° C., and the manufactured hot rolled steel sheet had a thickness of 1.8 mm.

The hot rolled steel sheet was coiled at a temperature of 620° C. and then air-cooled. Next, the hot rolled steel sheet was annealed at a temperature of 890° C. for 5 minutes.

In this case, the suitable temperature range in the hot rolled steel plate annealing process was in a range of 821° C.~940° C. The annealed hot rolled steel sheet was acid pickled, cold rolled at a thickness of 0.35 mm to form a cold rolled steel sheet, and then the cold rolled steel sheet was annealed at a temperature of 850° C. for 90 sec.

After the annealed steel sheet was coated with an organic-inorganic complex insulation film, dried and then cut, the magnetic properties of the obtained steel sheet and the texture coefficients were evaluated.

Among the magnetic properties of the steel sheet, iron loss ($W_{15/50}$) was 1.95 W/kg and magnetic flux density ($B_{50}$) was 1.66 Tesla. Further, texture coefficient at the center of the thickness of the steel sheet product was 2.02 in P200, and 1.45 in P211.

EXAMPLE 4

A steel slab composed of components given in Table 3, in which Mn was added using the amount of Mn given in Table 4, was reheated to a temperature of 1130° C., and finish rolled at a temperature of 900° C. in a hot rolling stage. In the hot rolling stage, the steel sheet had a thickness of 2.1 mm, and was coiled at a temperature of 600° C. The hot rolled steel sheet, coiled and cooled under ambient conditions was annealed as in Table 3 based on the temperature range given in Table 4, acid pickled, and then cold rolled to a thickness of 0.35 mm such that the reduction ratio thereof was 83%. Next, the cold rolled steel sheet was annealed in an atmosphere of 40% hydrogen and 70% nitrogen at an annealing temperature of 1040° C. for 1 minute. After the annealed steel sheet was cut, the magnetic properties of the obtained steel sheet and the texture coefficients according to a Horta formula were evaluated and compared. The results were given in Table 4.

TABLE 3

| | Component (wt. %) | | | | | | | | | | |
|---|---|---|---|---|---|---|---|---|---|---|---|
| Kind of steel | C | Si | S | P | Mn | Al | N | Ti | Sb | Ni | Cu |
| Invented steel A | 0.0021 | 3.15 | 0.0003 | 0.009 | 0.21 | 1.05 | 0.0011 | 0.0020 | 0.02 | 0.05 | 0.06 |
| Invented steel B | 0.0024 | 3.12 | 0.0005 | 0.005 | 0.29 | 1.04 | 0.0010 | 0.0018 | 0.05 | 0.03 | 0.03 |
| Invented steel C | 0.0025 | 3.13 | 0.0008 | 0.020 | 0.22 | 1.35 | 0.0009 | 0.0009 | 0.011 | 0.12 | 0.13 |
| Comparative steel A | 0.0019 | 3.14 | 0.0003 | 0.011 | 0.35 | 1.03 | 0.0010 | 0.0019 | 0.10 | 0.02 | 0.01 |
| Comparative steel B | 0.0025 | 3.13 | 0.0004 | 0.005 | 0.25 | 1.05 | 0.0011 | 0.0016 | 0.002 | 0.01 | 0.01 |
| Comparative steel C | 0.0026 | 3.15 | 0.0012 | 0.018 | 0.17 | 1.32 | 0.0010 | 0.0010 | 0.02 | 0.12 | 0.03 |

TABLE 4

| | Mn range | | Hot rolled steel plate annealing temperature range | |
|---|---|---|---|---|
| Kind of steel | 0.10 + 100 × S (%) | 0.21 + 200 × S (%) | 771 + 165000 × S (%) | 851 + 195000 × S (%) |
| Invented steel A | 0.13 | 0.27 | 821 | 910 |
| Invented steel B | 0.15 | 0.31 | 854 | 949 |
| Invented steel C | 0.18 | 0.37 | 903 | 1007 |
| Comparative steel A | 0.13 | 0.27 | 821 | 910 |
| Comparative steel B | 0.14 | 0.29 | 837 | 929 |
| Comparative steel C | 0.22 | 0.45 | 969 | 1085 |

TABLE 5

| | Kind of steel | Hot rolled steel plate annealing temperature (° C.) | 771 + 165000 × S (%) | 851 + 195000 × S (%) | Iron loss ($W_{15/50}$) (W/Kg) | Magnetic flux density ($B_{50}$) (Tesla) | Texture coefficient P200 | Texture coefficient P211 |
|---|---|---|---|---|---|---|---|---|
| Invented product 1 | Invented steel A | 880 | 821 | 910 | 2.01 | 1.66 | 1.10 | 0.67 |

TABLE 5-continued

| | Kind of steel | Hot rolled steel plate annealing temperature (° C.) | 771 + 165000 × S (%) | 851 + 195000 × S (%) | Iron loss ($W_{15/50}$) (W/Kg) | Magnetic flux density ($B_{50}$) (Tesla) | Texture coefficient P200 | Texture coefficient P211 |
|---|---|---|---|---|---|---|---|---|
| Invented product 2 | Invented steel B | 880 | 854 | 949 | 1.98 | 1.67 | 1.60 | 0.85 |
| Invented product 3 | Invented steel B | 900 | 854 | 949 | 1.85 | 1.67 | 1.95 | 0.93 |
| Invented product 4 | Invented steel B | 920 | 854 | 949 | 1.82 | 1.66 | 2.16 | 0.87 |
| Invented product 5 | Invented steel B | 940 | 854 | 949 | 1.83 | 1.67 | 2.01 | 0.91 |
| Comparative product 1 | Invented steel B | 960 | 854 | 949 | 2.07 | 1.65 | 0.82 | 0.93 |
| Comparative product 2 | Invented steel B | 980 | 854 | 949 | 2.10 | 1.64 | 0.73 | 0.89 |
| Invented product 6 | Invented steel C | 940 | 903 | 1007 | 1.98 | 1.66 | 2.04 | 0.78 |
| Comparative product 3 | Comparative steel A | 900 | 821 | 910 | 2.25 | 1.65 | 0.65 | 0.76 |
| Comparative product 4 | Comparative steel B | 920 | 837 | 929 | 2.14 | 1.64 | 0.56 | 0.82 |
| Comparative product 5 | Comparative steel C | 940 | 969 | 1085 | 2.09 | 1.64 | 0.61 | 0.86 |

1) Iron loss ($W_{15/50}$) is a loss (W/kg) occurring when a magnetic flux density of 1.5 Tesla is induced at a frequency of 50 Hz.

2) Magnetic flux density ($B_{50}$) is an intensity (Tesla) of magnetic flux induced when a magnetic filed of 5000 A/m is applied.

3) P200 and P211 are texture coefficients measured using the Horta formula, and are average values of 3 points or more at the center of the thickness of the steel sheet. P200 is a crystal plane advantageous to magnetic properties, and P211 is a crystal plane disadvantageous to magnetic properties.

As shown in Table 5, it can be seen that the invented products (1~5, 6), which are manufactured under the manufacturing conditions of the present invention using the invented steel (A~C) meeting the composition range of the present invention, have low iron losses and high magnetic flux densities compared to the comparative products (1~2) when the manufacturing conditions are different, even if the composition range is the same. Further, it was evaluated that the comparative steels (A~C), which has different compositions from the present invention, had bad magnetic properties even if they were manufactured under the same manufacturing conditions. Moreover, in the comparative steels A and C, the amount of Mn exceeded the range of the present invention, and, in the comparative steel B, the amount of Sb exceeded the range of the present invention.

EXAMPLE 5

A steel slab, comprising 0.0023 wt. % C; 3.2 wt. % Si; 0.0051 wt. % P; 0.0003 wt. % S; 0.65 wt. % Al; 0.0013 wt. % N; 0.0015 wt. % Ti; 0.02 wt. % Sb; 0.04 wt. % Ni; 0.05 wt. % Cu; 0.23 wt. % Mn in which a preferable amount thereof was 0.13~0.27 wt. %; a balance of iron; and inevitable impurities, was reheated to a temperature of 1100° C., and was then hot rolled. In this hot rolling stage, the final rolling in the finish rolling was performed at a temperature of 860° C., thereby manufacturing a hot rolled steel sheet having a thickness of 2.1 mm. The hot rolled steel sheet was coiled at a temperature of 680° C., continuously annealed at a temperature of 890° C. for 5 minutes, acid pickled, and then cold rolled to a thickness of 0.5 mm. In this case, the suitable temperature range in the hot rolled steel plate annealing process was in a range of 821~910° C. A cold rolled steel plate annealing process was performed at a temperature of 1000° C. under ambient conditions of 60% nitrogen and 40% hydrogen for 1.5 minutes. After the annealed steel sheet was coated with an organic-inorganic complex insulation film and cut, the magnetic properties of the obtained steel sheet and the sizes of crystal grains were evaluated. Among the magnetic properties of the steel sheet, iron loss ($W_{15/50}$) was 2.19 W/kg and magnetic flux density ($B_{50}$) was 1.69 Tesla. Further, the texture coefficient at the center of the thickness of the steel sheet product was 2.70 in P200 and was 1.21 in P211, and (P200-P211) was 1.49, therefore P200 was greater than P211.

EXAMPLE 6

A steel slab, comprising 0.0021 wt. % C; 3.5 wt. % Si; 0.025 wt. % P; 0.0004 wt. % S; 1.35 wt. % Al; 0.0012 wt. % N; 0.0019 wt. % Ti; 0.03 wt. % Sb; 0.07 wt. % Ni; 0.05 wt. % Cu; 0.24 wt. % Mn in which a preferable amount thereof is 0.14~0.29 wt. %; the balance of iron; and inevitable impurities, was reheated to a temperature of 1150° C., and was then hot rolled. In the hot rolling stage, the end temperature in finish rolling was 880° C., and the manufactured hot rolled steel sheet had a thickness of 1.6 mm. The hot rolled steel sheet was coiled at a temperature of 600° C. and then was annealed at a temperature of 910° C. for 5 minutes. The suitable temperature range in the hot rolled steel plate annealing process was in a range of 837° C.~929° C. The annealed hot rolled steel sheet was acid pickled, cold rolled at a thickness of 0.35 mm to form a cold rolled steel sheet, and then the cold rolled steel sheet was annealed at a temperature of 850° C. for 90 sec. After the annealed steel sheet was cut, the magnetic properties of the obtained steel sheet and the texture coefficients were evaluated. Among the magnetic properties of the steel sheet, iron loss ($W_{15/50}$) was 1.85 W/kg and magnetic flux density ($B_{50}$) was 1.65 Tesla. Further, the texture coefficient at the center of the thickness of the steel sheet product was 2.35 in P200 and was 1.12 in P211, and P 200 was greater than P211.

INDUSTRIAL APPLICABILITY

As described above, according to the present invention, final magnetic properties are greatly improved because fine precipitates are formed by S, the amount of Mn can be suitably determined in order to inhibit the formation of the fine precipitates, the formation of the fine precipitate CuS is inhibited because precipitates CuS, MnS are formed by adding Sn, Ni and Cu, and texture, which determines a temperature of annealing a hot rolled steel plate and magnetic properties, is controlled, thereby manufacturing an inexpensive and optimal non-oriented electrical steel sheet.

The invention claimed is:

1. A non-oriented electrical steel sheet having excellent magnetic properties, comprising:

0.004 wt. % or less C;

1.0~3.5 wt. % Si;

0.02 wt. % or less P;

0.001 wt. % or less S;

0.65~2.5 wt. % Al;

0.003 wt. % or less N;

0.004 wt. % or less Ti;

Mn, in which an amount thereof is represented by the following formula (1):

$$0.10+100\times S(\text{wt. }\%)\leqq Mn(\text{wt. }\%)\leqq 0.21+200\times S(\text{wt. }\%) \quad (1);$$

a balance iron; and inevitable impurities;

wherein a texture coefficient at the center of the thickness of the manufactured steel sheet is represented by the following formula (2):

$$P200>P211 \quad (2),$$

wherein P200 is a texture coefficient attained in a (200) plane, and P211 is a texture coefficient attained in a (211) plane.

2. The non-oriented electrical steel sheet having excellent magnetic properties according to claim 1, wherein the electrical steel sheet further comprises 0.005~0.07 wt. % Sb, 0.005~0.50 wt. % Ni, and 0.005~0.20 wt. % Cu.

3. A method of manufacturing a non-oriented electrical steel sheet having excellent magnetic properties, comprising the steps of:

hot rolling a steel slab having the same composition as in claim 1 into a steel plate;

annealing the hot rolled steel plate in a temperature range represented by the following formula (3) depending on an amount of S:

$$771+165000\times S(\text{wt. }\%)\leqq \text{temperature of annealing a rolled steel plate (}^\circ\text{ C.)}\leqq 851+195000\times S(\text{wt. }\%) \quad (3);$$

cold rolling the annealed steel plate; and annealing the cold rolled steel plate, thus providing the steel sheet;

wherein a texture coefficient at the center of the thickness of the steel sheet manufactured through the method is represented by the following formula (2):

$$P200>P211 \quad (2),$$

wherein P200 is a texture coefficient attained in a (200) plane, and P211 is a texture coefficient attained in a (211) plane.

4. The method of manufacturing a non-oriented electrical steel sheet having excellent magnetic properties according to claim 3, wherein:

the steel slab is reheated to a temperature of 1200° C. or less and coiled at a temperature of 680° C. or less, in the hot rolling the steel slab, the cold rolling the steel plate is performed to have a reduction ratio of 70~88%, and the annealing the cold steel plate is continuously performed at a temperature of 800~1070° C.

5. The method of manufacturing a non-oriented electrical steel sheet having excellent magnetic properties according to claim 3, wherein the steel slab further comprises 0.005~0.07 wt. % Sb, 0.005~0.50 wt. % Ni, and 0.005~0.20% wt. % Cu.

6. The method of manufacturing a non-oriented electrical steel sheet having excellent magnetic properties according to claim 4, wherein the steel slab further comprises 0.005~0.07 wt. % Sb, 0.005~0.50 wt. % Ni, and 0.005~0.20% wt. % Cu.

* * * * *